United States Patent [19]

Hwang

[11] Patent Number: 5,046,714

[45] Date of Patent: Sep. 10, 1991

[54] PAPER FEEDER FOR A COPYING MACHINE

[75] Inventor: Nag-Hyo Hwang, Seoul, Rep. of Korea

[73] Assignee: SamSung Electronics Co., Ltd., Suwon, Rep. of Korea

[21] Appl. No.: 446,872

[22] Filed: Dec. 6, 1989

[30] Foreign Application Priority Data

Mar. 30, 1989 [KR] Rep. of Korea ..... 1989-4108

[51] Int. Cl.[5] ..... B65H 1/00

[52] U.S. Cl. ..... 271/162; 271/127; 271/164

[58] Field of Search ..... 271/127, 162, 164, 126, 271/157

[56] References Cited

U.S. PATENT DOCUMENTS 4,346,878 8/1982 Aizawa ..... 271/127 X 4,660,823 4/1987 Sato ..... 271/164 X 4,728,094 3/1988 Yoshida ..... 271/127 X

FOREIGN PATENT DOCUMENTS 63-267620 11/1988 Japan ..... 271/127

*Primary Examiner*—David H. Bollinger

*Assistant Examiner*—Cheryl L. Gastineau

*Attorney, Agent, or Firm*—Robert E. Bushnell

[57] ABSTRACT

There is disclosed a paper feeder for a copying machine, including a paper feeding tray sub-member having guiding projections and stoppers for properly loading a paper feeding tray, a pivot for pivotally mounting the paper feeding tray sub-member in the position adjacent to a paper guide, a lever mounted on the underside of the paper feeding tray sub-member, and a slanting position fixing member attached to the body of the copying machine for fixing the lever and thus the slanting position of the paper feeding tray sub-member.

6 Claims, 5 Drawing Sheets

PAPER FEEDER FOR A COPYING MACHINE

BACKGROUND OF THE INVENTION

The present invention generally concerns a paper feeder and, more particularly, a paper feeder for use in a electronic photo processor such as a copying machine, facsimile, laser printer and light emitting diode (LED) printer, said paper feeder being capable of decreasing occupational space which might be taken by the paper feeder.

Known electronic photo processors, as is illustrated in FIG. 1A and 1B, usually includes a photo-sensitive drum 40, an electrifying device 41, developer 42, transcriber 43, image fixing device 44, cleaner 45 and paper transfer belt 46. In the prior art system, the paper feeding tray 50 is loaded upwardly (FIG. 1A) or downwardly (FIG. 1B) at the body of the system. Pick-up roller 51 conveys the papers to paper guide 52. Then, resistor roller 53 transfers the papers to the photo-sensitive drum 40 one by one, so that the image taken by the photo-sensitive drum 40 is transcribed onto the paper. Then, the paper passes the image fixing device 44 for fixing the image, thereafter being discharged finally to the paper-oulet tray 48.

In such a conventional copying machine, because the paper feeding tray 50 juts out of the machine body, and is loaded or unloaded horizontally, it requires large space for mounting, thereby making it difficult to make use of a limited small space. Besides, the loading position of the paper feeding tray is permanently fixed, which causes the user to suffer inconvenience for loading the paper feeding tray.

SUMMARY OF THE INVENTION

An object of the present invention is to provide a paper feeder capable of changing the loading position of the paper feeding tray so as to effectively utilize a limited space for mounting.

According to the present invention, a paper feeder for use in a copying machine includes a paper feeding tray submember having guiding projections and stoppers for properly loading a paper feeding tray, a pivot for pivotally mounting the paper feeding tray sub-member in the position adjacent to paper guide, a lever mounted on the underside of the paper feeding tray sub-member, and a slanting position fixing member attached to the body of the copying machine for fixing the lever and thus the slanting position of the paper feeding tray sub-member.

BRIEF DESCRIPTION OF THE DRAWINGS

For a better understanding of the invention and to show how the same may be carried into effect, reference will now be made, by way of example, to the accompanying diagrammatic drawings, in which.

DETAILED DESCRIPTION OF THE PREFERRED EMBODIMENTS

The present invention will now be described more specifically with reference to the drawings attached, only by way of example.

Figure 1A:
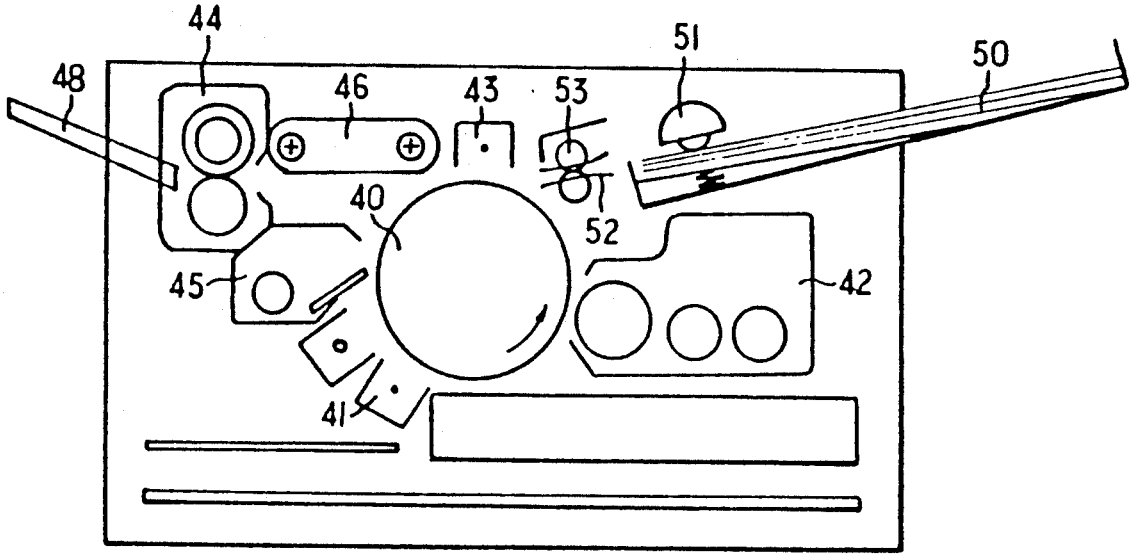
FIGS. 1A and 1B schematically show structure of a conventional copying machine.
Figure 1B:
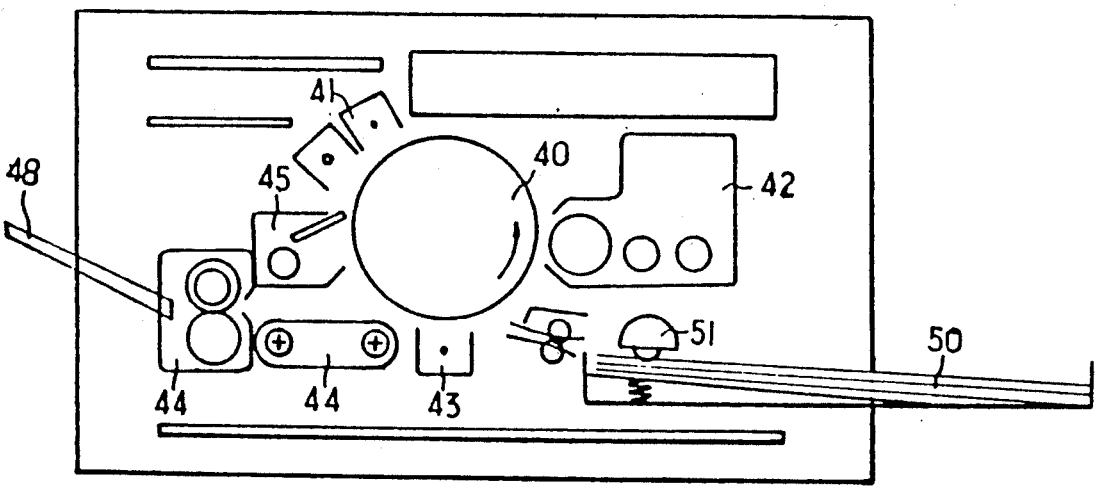
Figure 2:
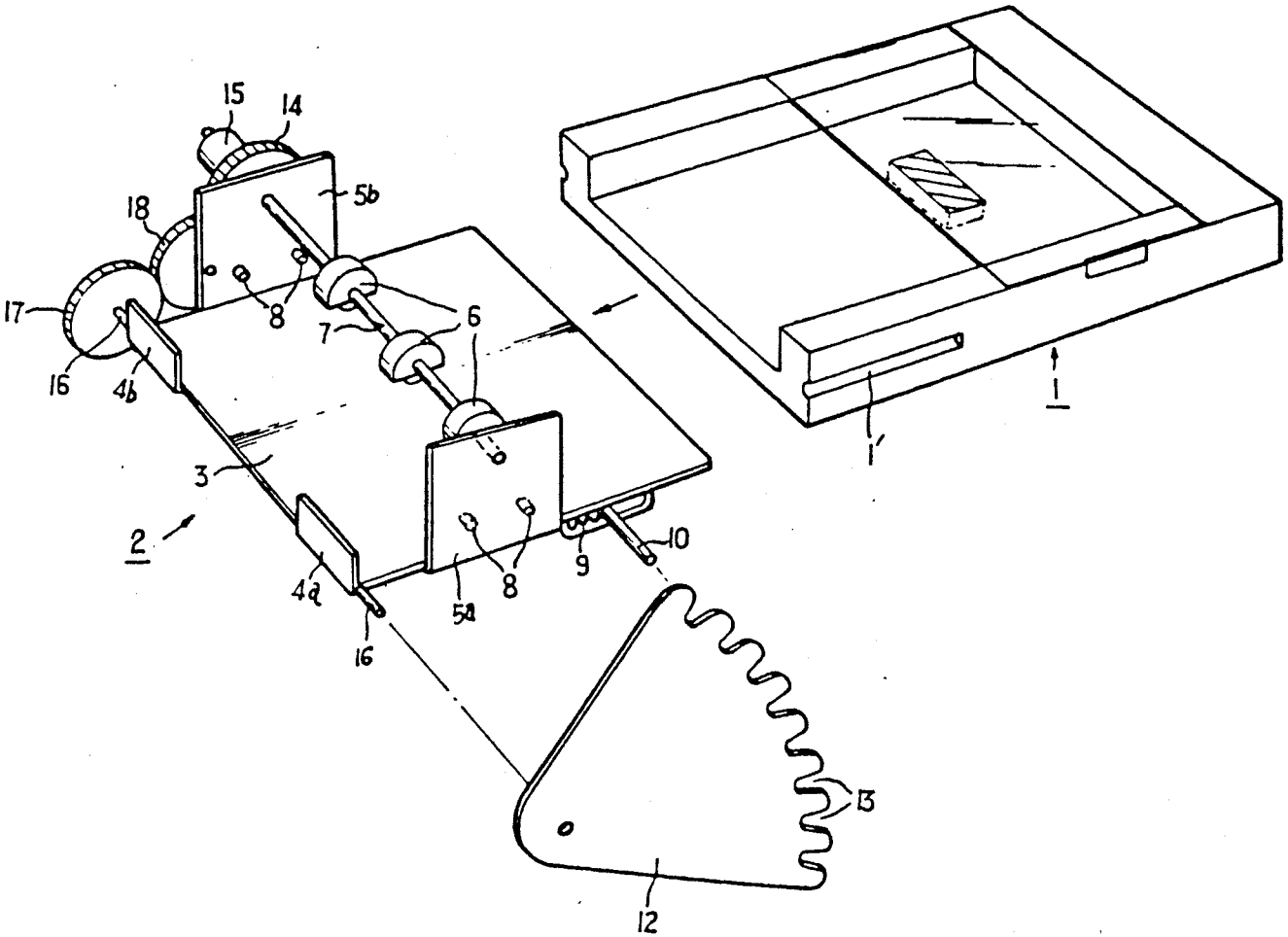
FIG. 2 shows an exploded perspective view of a paper feeder according to the present invention.
Figure 3:
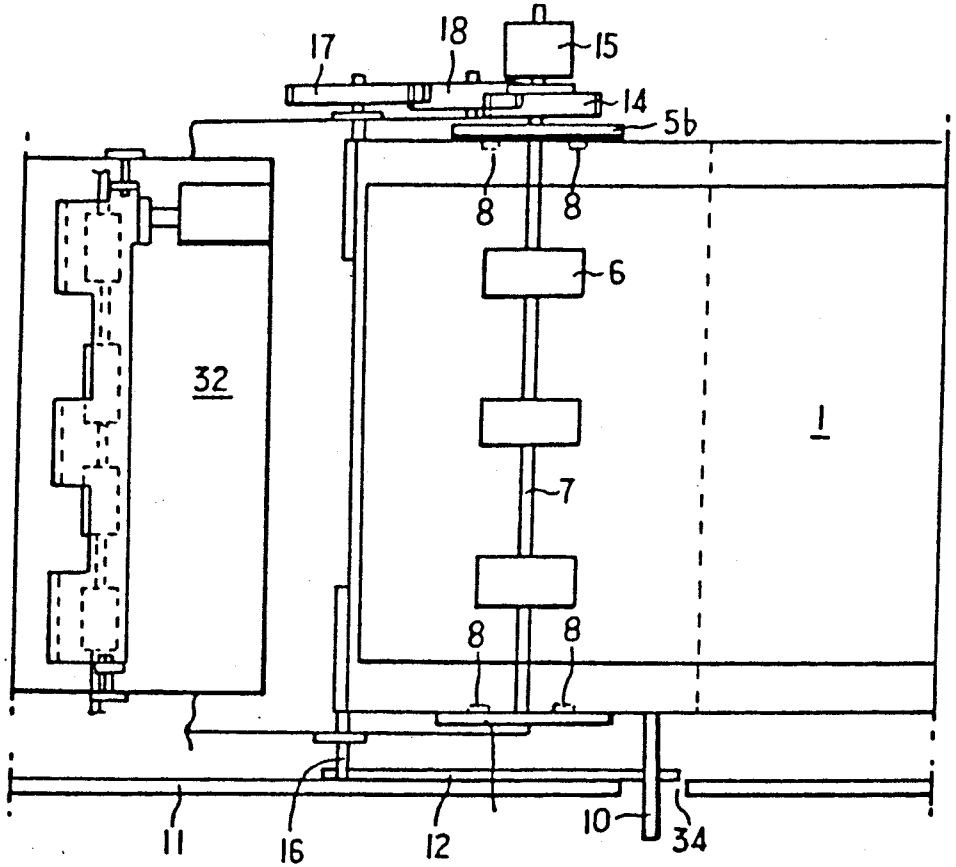
FIG. 3 shows a plane view of the paper feeder of FIG. 2.
Figure 4:
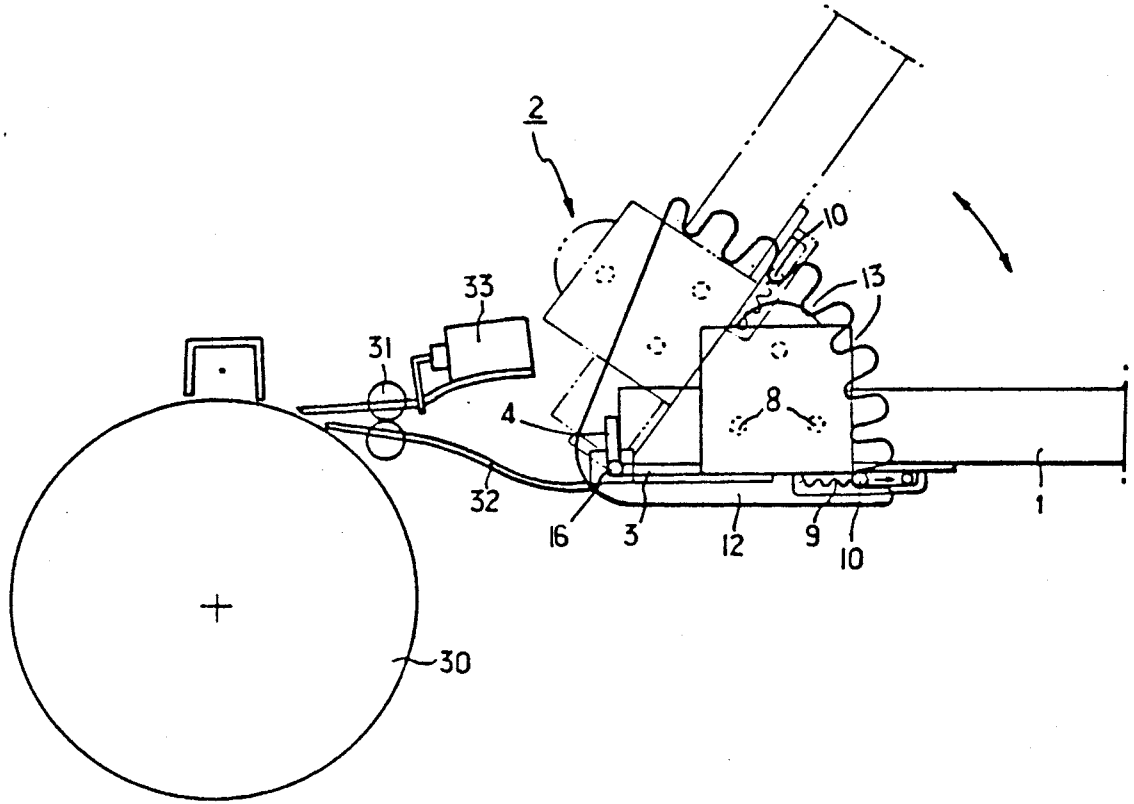
FIG. 4 shows an operational view of the paper feeder.

Referring to FIGS. 2 and 4, paper feeding tray sub-member 2 comprises bottom plate 3, stoppers **4*a* and 4*b* formed at the front of the bottom plate for limiting the forward movement of the paper feeding tray 1, a pair of supporting walls 5*a* and 5*b* respectively formed at both sides of the bottom plate, a lever 10 resiliently supported by spring 9 on the underside of the bottom plate 3, and slanting position fixing member 12 mounted on the wall 11 of the machine body. The supporting wall 5*a* and 5*b* support the shaft 7 of pick-up roller 6 at their upper portions, and have guiding projections 8 at their lower portions which are inserted in grooves 1' provided in both sides of the paper feeding tray 1 to support it. On the periphery of the slanting position fixing member 12 are formed a plurality of retaining cuts 13 for engaging the lever 10. Driving gear 14 for driving the pick-up roller 6 engages electronic clutch 15 and idler gear 18, which in turn engages paper feeding gear 17 mounted on pivot 16. The reference numerals 30, 31, 32, 33 and 34 respectively indicate photo-sensitive drum, register roller, paper feeding guide, paper sensor, and a hole formed in the wall 11** for receiving the lever.

The operational effect of the present invention will now be described.

The paper feeding tray sub-member 2 is pivotally mounted on the pivot 16 so as to properly change the direction of loading of paper feeding tray 1 for convenience. More specifically describing the structure with reference to FIGS. 4 and 5, the sub-member 2 is pivotally mounted on the pivot 16 supported by the slanting position fixing member 12 adjacent to the paper guide 32 for guiding the papers to the register roller 31. The lever 10 resiliently supported by the spring 9 on the underside of the bottom plate 3 of the sub-member 2 engages one of the retaining cuts 13 formed on the periphery of the slanting position fixing member 12 fixedly attached to the machine body, thereby finally fixing the position of the sub-member 2. For example, the solid line in FIG. 4 shows the paper feeding tray 1 loaded horizontally. When loading the paper feeding tray 1, the projections 8 formed in the supporting walls **5*a* and 5*b* of the sub-member 2 are inserted in the grooves 1' formed in the side walls of the tray 1, thereby preventing oscillation of the tray 1. The stoppers 4*a* and 4*b* formed at the front end of the bottom plate 3 limit the forward movement of the paper feeding tray 1**.

When the copying machine is started, the paper feeding gear 17 drives the idler gear 18 engaging the pick-up roller driving gear 14, so that the pick-up rollers 6 are driven via the electronic clutch 15 to convey the papers to the photo-sensitive drum 30. The paper fed from the tray 1 is conveyed through the paper guide 32 to the register roller 31. When the sensor 33 detects the conveyed paper, the resistor roller 31 is driven to move the paper to the photo-sensitive drum 30 to transcribe onto the paper the image formed on the photo-sensitive drum 30. Such functions are conventional, therefore no further description will be needed.

When slantingly loading the paper feeding tray 1, the lever 10 projected outside of wall 11 of the machine body is drawn backwards, being released from the retaining cut 13 of the slanting position fixing member 12.

Then, the paper feeding tray sub-member 2 is moved to a position convenient for use, and thereafter, the lever 10 is caused to be inserted again in a retaining cut 13 of the fixing member 12 by the spring 9 to fix the position of the sub-member 2. Although the pivoting motion of the sub-member 2 causes the paper feeding gear 17 to rotate, the driving gear 14 and idler gear 18 idle so as not to drive the pick-up roller 6 because the electronic clutch 15 is disconnected, so that the paper is not fed from the tray 1. Further, since the paper feeding gear 17 and the sub-member 2 commonly occupy the same pivot 16, it is not necessary to change the driving system of the machine for rotation of the sub-member 2.

Figure 5A:
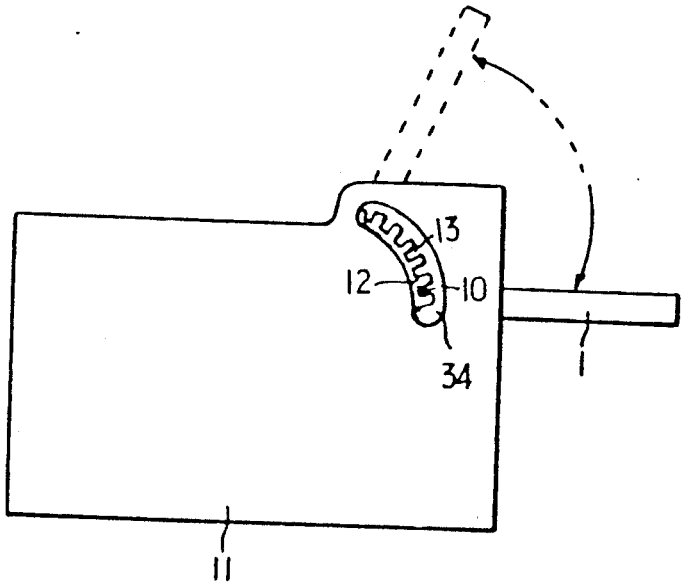
FIGS. 5A and 5B show two different embodiments of the present invention.
Figure 5B:
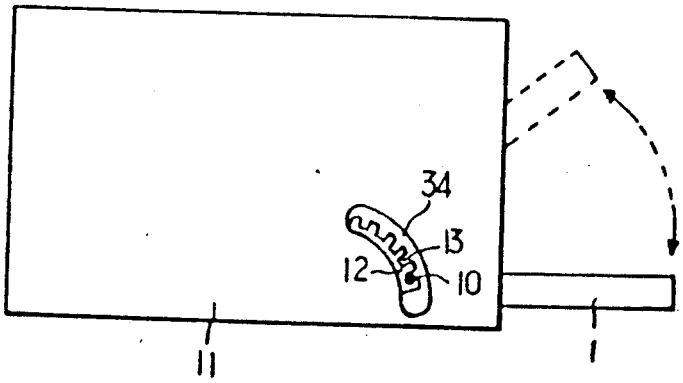

When the paper feeding tray 1 is positioned slantingly, it is preferable that the paper guide 32 is made somewhat longer and curved smoothly towards the inside so as to properly convey the paper to the register roller 31. As shown in FIGS. 5A and 5B, the paper feeder of the present invention may be made so as to arrange the paper feeding tray above or below the photosensitive drum 30 without departing from the spirit of the invention.

As described above, the copying machine of the present invention makes it possible to utilize a relatively small space and for the user to properly load the paper feeding tray in a most convenient position.

What is claimed is:

1. A paper feeder accessory for a copying machine, comprising:

a paper feeding tray sub-member having projecting means for guiding a paper tray received by said sub-member and means for stopping forward travel of a paper tray received by said sub-member, for loading a paper feeding tray;

a pivot for pivotally mounting said paper feeding tray sub-member in a copying machine;

a paper guide mounted adjacent to said pivot;

a lever mounted on the underside of said paper feeding tray sub-member; and a slanting position member attached to a body of said copying machine, for restraining said lever and thus maintaining said paper feeding tray sub-member in a slanting position relative to a horizontal plane.

2. The paper feeder for a copying machine as claimed in claim 1, wherein means for engaging said lever with said slanting position member comprises at least two retaining cuts formed in the periphery of said slanting position member.

3. The paper feeder for a copying machine as claimed in claim 1, wherein said paper guide is curved toward a register roller, so that the papers are smoothly fed to said register roller when said paper feeding try is loaded at upper portion of the body of said copying machine.

4. A paper feeder accessory for a copying machine, comprising:

sub-member including projecting means for guiding a paper tray into alignment with a copying machine;

means attached to said sub-member, for enabling said sub-member to pivotally engage the copying machine;

a lever mounted on the underside of said sub-member; and means attached to the copying machine, for engaging said lever and thus maintaining said sub-member in a horizontal position or in one of a plurality of positions oblique to said horizontal position.

5. The paper feeder for a copying machine as claimed in claim 4, wherein said engaging means comprises at least two slots formed in periphery of said engaging means.

6. The paper feeder for a copying machine as claimed in claim 4, further comprised of a paper guide curved toward a register roller, so that the papers are smoothly fed to the register roller when the paper tray is loaded at upper portion of the copying machine.

* * * * *